US011834289B2

(12) United States Patent
Yamazaki

(10) Patent No.: US 11,834,289 B2
(45) Date of Patent: Dec. 5, 2023

(54) INTERMITTENT FEED DEVICE

(71) Applicant: Totani Corporation, Kyoto (JP)

(72) Inventor: Ryota Yamazaki, Kyoto (JP)

(73) Assignee: Totani Corporation, Kyoto (JP)

( * ) Notice: Subject to any disclaimer, the term of this patent is extended or adjusted under 35 U.S.C. 154(b) by 531 days.

(21) Appl. No.: 17/261,137

(22) PCT Filed: Jun. 18, 2019

(86) PCT No.: PCT/JP2019/024064
§ 371 (c)(1),
(2) Date: Jan. 18, 2021

(87) PCT Pub. No.: WO2020/026620
PCT Pub. Date: Feb. 6, 2020

(65) Prior Publication Data

US 2021/0292122 A1 Sep. 23, 2021

(30) Foreign Application Priority Data

Aug. 2, 2018 (JP) ..... 2018-145633

(51) Int. Cl.
*B65H 39/16* (2006.01)
*B65H 23/10* (2006.01)
*B31B 70/10* (2017.01)

(52) U.S. Cl.
CPC ..... *B65H 23/105* (2013.01); *B65H 39/16* (2013.01); *B31B 70/10* (2017.08)

(58) Field of Classification Search
CPC ..... B65H 23/105; B65H 39/16; B31B 70/10
See application file for complete search history.

(56) References Cited

U.S. PATENT DOCUMENTS 11,390,483 B2 * 7/2022 Kurosaki ..... B65H 20/02
2018/0237249 A1 * 8/2018 Li ..... B65H 23/195

FOREIGN PATENT DOCUMENTS

| | | | |
|---|---|---|---|
| JP | 55-089148 | A | 7/1980 |
| JP | 4121722 | B2 | 7/2008 |
| JP | 4461201 | B2 | 5/2010 |
| JP | 5346113 | B1 | 11/2013 |
| JP | 6288771 | B2 | 3/2018 |

OTHER PUBLICATIONS

International Search Report dated Aug. 6, 2019 by the International Searching Authority (Japan Patent Office) in PCT Application PCT/JP2019/024064.

* cited by examiner

*Primary Examiner* — Sang K Kim
(74) *Attorney, Agent, or Firm* — NovoTechIP International PLLC

(57) ABSTRACT

Webs include print patterns repeated at print pitches. The first web is intermittently fed at the print pitch of the first web by a first pair of feed rollers to a section. The second web is fed at the print pitch of the second web by a second pair of feed rollers to the section. The first web and the second web are fed in a superposed state by a downstream pair of feed rollers from the section. A first tension roller and a second tension roller engaging with the first web and the second web are biased by a biasing member via a linkage.

2 Claims, 5 Drawing Sheets

INTERMITTENT FEED DEVICE

TECHNICAL FIELD

The present invention relates an intermittent feed device for superposing webs on each other each unwound from a roll, and feeding the webs.

BACKGROUND

Some bag making apparatuses make plastic bags with print patterns from two or more webs. For this, each of the webs has the print patterns printed at a constant print pitch.

For example, a bag making apparatus includes an intermittent feed device which intermittently feeds webs each unwound from a roll at a print pitch. The intermittent feed device intermittently feeds the webs in a superposed state to some process devices disposed downstream thereof. A heat seal device and a cross cut device are used as the process devices. The process devices process the webs during every intermittent feed cycle, so that plastic bags are made from the webs.

The print patterns of the webs should be aligned with each other when the webs are superposed on each other. If there are minor errors in the print pitches of the webs, the accumulation of these minor errors can cause a problem such that the print patterns of the webs are misaligned with each other.

The intermittent feed device disclosed in each of Patent documents 1 to 3 corrects the print pitch of the web. Patent document 1 discloses that the web is stretched by means of application of heat such that the print pitch is corrected. However, the application of heat can be unfavorable for the web. Patent documents 2 and 3 disclose that the web is stretched by means of rolling a plurality of slide rollers such that the print pitch is corrected. However, a large slide roller drive mechanism is required to roll the slide rollers.

The intermittent feed device disclosed in each of Patent documents 4 and 5 uses a parallelogram linkage to prevent misalignment of the positional relationship between the webs. However, this linkage is applicable only when a wide web is unwound from a roll and then slit in the longitudinal direction thereof into the webs.

An object of the present invention is to provide an intermittent feed device capable of intermittently feeding webs while correcting print pitches in a novel manner.

SUMMARY

According to an aspect of the present invention, there is provided an intermittent feed device for intermittently feeding a first web unwound from a first roll and a second web unwound from a second roll. Each of the first web and the second web has print patterns repeated at a print pitch, and each of the print patterns includes a detection point.

The intermittent feed device includes a first sensor for detecting the detection point of the first web, a first pair of feed rollers disposed downstream of the first sensor, and a first motor for driving the first pair of feed rollers based on detection signals from the first sensor such that the first web is intermittently fed by the first pair of feed rollers at the print pitch of the first web.

The intermittent feed device further includes a second sensor for detecting the detection point of the second web, a second pair of feed rollers disposed downstream of the second sensor, and a second motor for driving the second pair of feed rollers based on detection signals from the second sensor such that the second web is intermittently fed by the second pair of feed rollers at the print pitch of the second web.

The intermittent feed device further includes a downstream pair of feed rollers disposed downstream of the first pair of feed rollers and the second pair of feed rollers, and a downstream motor for driving the downstream pair of feed rollers such that the first web and the second web are intermittently fed in a superposed state by the downstream pair of feed rollers.

The intermittent feed device further includes a first arm supported at a first support point to be pivotable about the first support point, a second arm supported at a second support point to be pivotable about the second support point in a same direction as the first arm, and a link linked to the first arm at a first link point and to the second arm at a second link point. Thereby, a parallelogram linkage is constituted. Joints of the parallelogram linkage are the first support point, the second support point, the first link point and the second link point.

The intermittent feed device further includes a first tension roller supported by the first arm to be spaced from the first support point at a predetermined distance, and a second tension roller supported by the second arm to be spaced from the second support point at a same distance as the predetermined distance. The first tension roller is located downstream of the first pair of feed rollers and upstream of the downstream pair of feed rollers to engage with the first web. The second tension roller is located downstream of the second pair of feed rollers and upstream of the downstream pair of feed rollers to engage with the second web.

The intermittent feed device further incudes a biasing member for biasing the first tension roller and the second tension roller via the parallelogram linkage to apply tension to the first web and the second web.

In the intermittent feed device with the above features, when the print pitch of the first web and the print pitch of the second web are different from each other, at least a web with a shorter print pitch of the first web and the second web is stretched by the tension generated by the biasing member such that the print pitch of the first web and the print pitch of the second web are aligned with each other.

In one embodiment, the biasing member may be a cylinder.

DETAILED DESCRIPTION

Embodiments of an intermittent feed device according to the present invention will be described with reference to the drawings.

Figure 1:
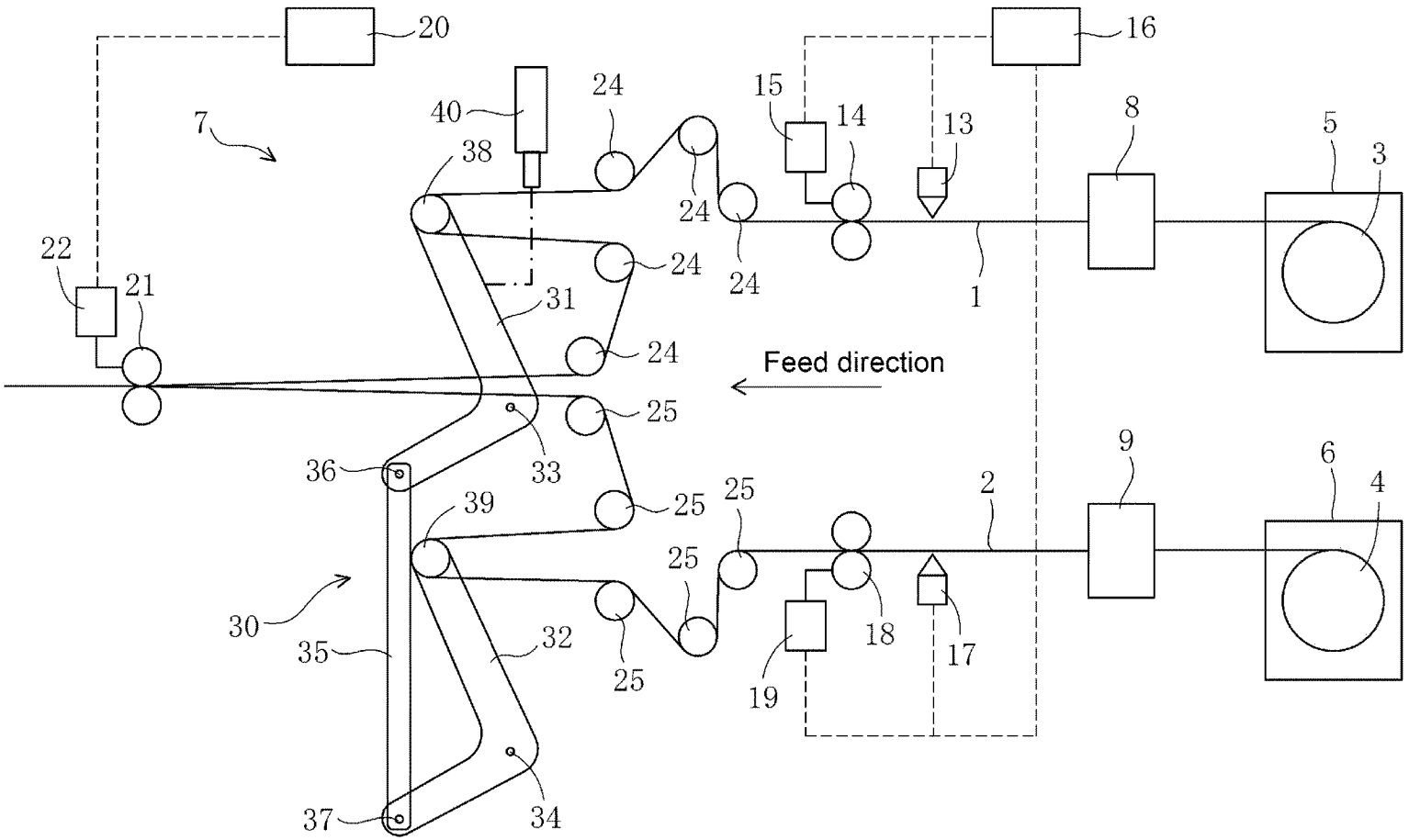
FIG. 1 is a schematic view of an upstream section of a bag making apparatus according to an embodiment.

FIG. 1 illustrates an upstream section of a bag making apparatus for successively making plastic bags with print patterns. The bag making apparatus includes a first unwind device 5 configured to support a first roll 3 and to continuously unwind a first web 1 from the first roll 4, and a second unwind device 6 configured to support a second roll 4 and to continuously unwind a second web 2 from the second roll 4.

Figure 5A:
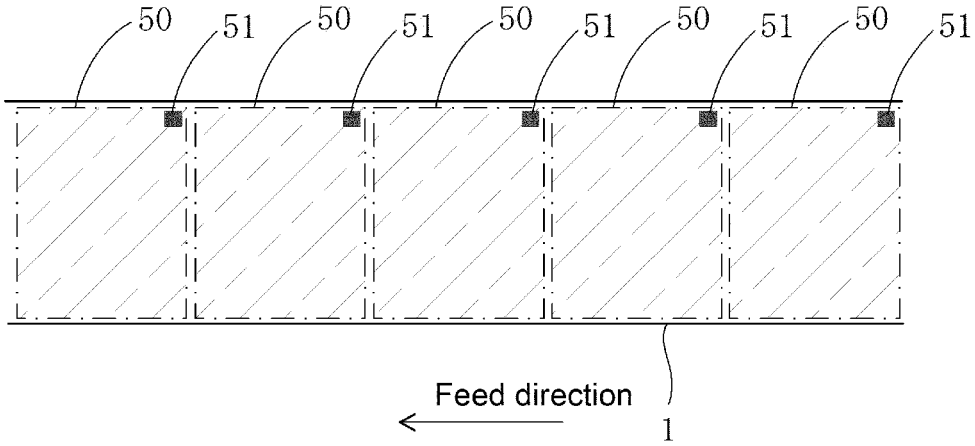
FIG. 5A is a plan view of a first web in FIG. 1.
Figure 5B:
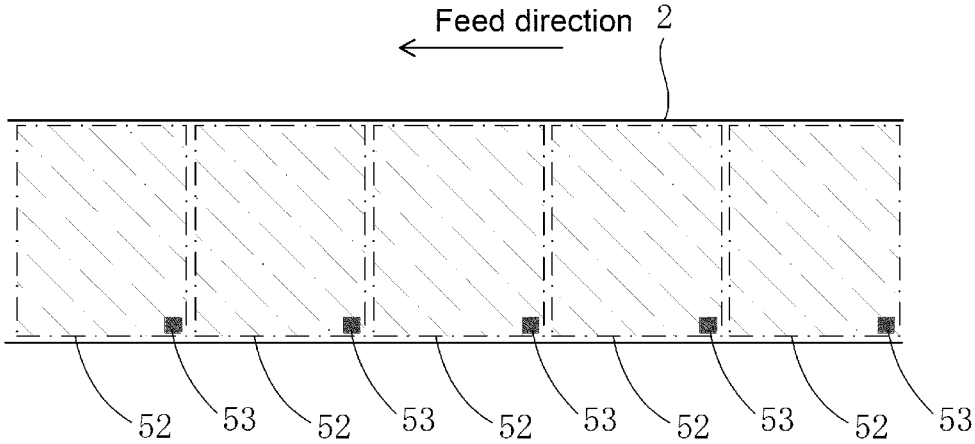
FIG. 5B is a bottom view of a second web in FIG. 1.

As illustrated in FIG. 5A, which is a plan view, the first web 1 includes print patterns 50 repeated at a constant print pitch. A detection point 51 is included in each of the print patterns 50 at the predetermined position. As illustrated in FIG. 5B, which is a bottom view, the second web 2 includes print patterns 52 repeated at a constant print pitch. A detection point 53 is included in each of the print patterns 52 at the predetermined position. Therefore, the detection points 51/53 are repeated at the print pitch. Each of the first and second webs 1 and 2 is a continuous plastic film.

An intermittent feed device 7 is incorporated into the bag making apparatus and disposed downstream of the first and second unwind devices 5 and 6. The intermittent feed device 7 is configured to intermittently feed the first web 1 unwound from the first roll 3 and the second web 2 unwound from the second roll 4 at their print pitches. The intermittent feed device 7 is further configured to superpose the first and second webs 1 and 2 on each other and to feed the first and second webs 1 and 2 in a superposed state.

The bag making apparatus further includes a first dancer device 8 disposed between the first unwind device 5 and the intermittent feed device 7, and a second dancer device 9 disposed between the second unwind device 6 and the intermittent feed device 7. The first dancer device 8 is configured to apply tension to the first web 1 to appropriately switch the continuous feed of the first web 1 to the intermittent feed. The second dancer device 9 is configured to apply tension to the second web 2 to appropriately switch the continuous feed of the second web 2 to the intermittent feed. In this embodiment, the first and second dancer devices 8 and 9 are configured dependently as illustrated in FIG. 1. They may be vertically configured in one unit.

Figure 2:
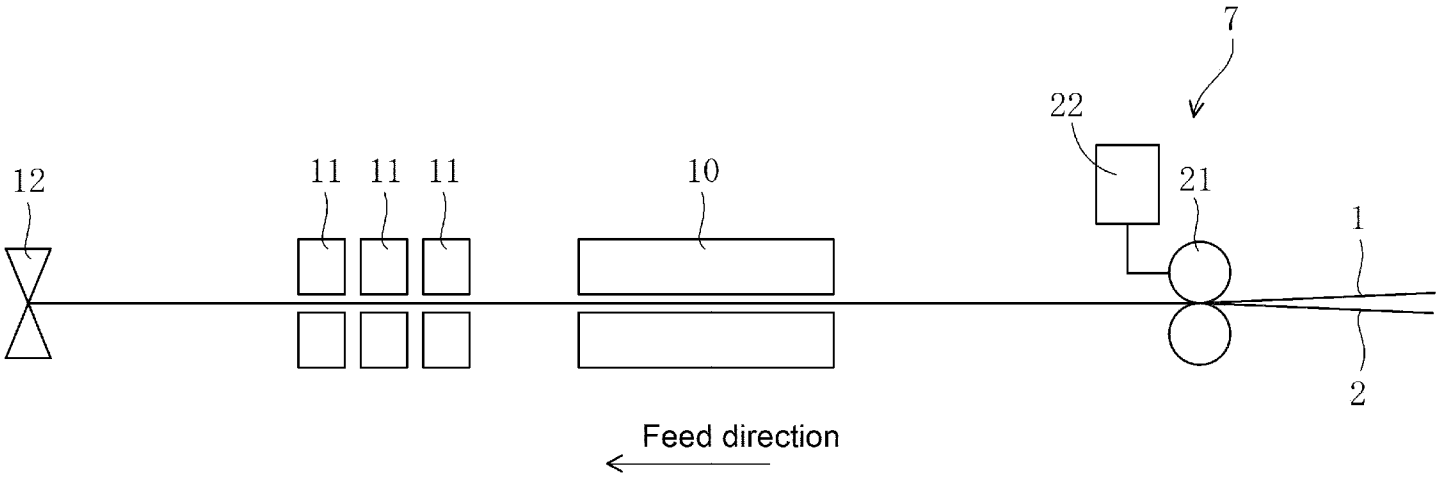
FIG. 2 is a schematic view of a downstream section of the bag making apparatus in FIG. 1.

FIG. 2 schematically illustrates a downstream section of the bag making apparatus. Process devices 10, 11 and 12 are disposed downstream of the intermittent feed device 7. The first and second webs 1 and 2 are processed by the process devices 10, 11 and 12, so that plastic bags are successively made from the first and second webs 1 and 2.

A longitudinal heat seal device 10, a cross heat seal device 11 and a cross cut device 12 are used as the process devices. During every intermittent feed cycle, the first and second webs 1 and 2 superposed on each other are heat-sealed in a continuous direction thereof by the longitudinal heat seal device 10, heat-sealed in the width direction thereof by the cross heat seal device 11, and cross-cut in the width direction thereof by the cross cut device 12. Thereby, the plastic bags are made.

Referring back to FIG. 1, the intermittent feed device 7 further includes a first sensor 13 for detecting the detection points 51 of the print patterns 50 of the first web 1, a first pair of feed rollers 14 disposed downstream of the first sensor 13, and a first motor 15 for driving the first pair of feed rollers 14 based on signals from the first sensor 13.

An optical sensor is used as the first sensor 13. The detection points 51 of the first web 1 are optically detected by the first sensor 13. Rubber rollers are used as the first pair of feed rollers 14. A servomotor is used as the first motor 15. When the first pair of feed rollers 14 is driven by the first motor 15, at least one of the feed rollers rotates. Thus, when the first pair of feed rollers 14 is driven by the first motor 15, the first web 1 sandwiched between the first pair of feed rollers 14 is fed.

The first sensor 13 and the first motor 15 are connected to a control device 16. The first motor 15 is controlled by the control device 16 based on the signals from the first sensor 13 to drive the first pair of feed rollers 14 such that the first web 1 is intermittently fed at the print pitch of the first web 1 by the first pair of feed rollers 14.

This control will be described in detail. First, the number of rotations of the first pair of feed rollers 14 is set such that the first web 1 is intermittently fed at the print pitch thereof. From the aspect of facilitating the detection, the detection points 51 included in the first web 1 are, for example, high-contrast points (contrast changing points) repeated at the print pitch on the print patterns. The detection points 51 may be specific marks or codes. The first sensor 13 is disposed so as to oppose a detection point 51 of the first web 1 when the first web 1 is paused during the intermittent feed cycle. This position is defined as the initial position. The first sensor 13 is movable in the feed direction of the first web 1 and its opposing direction, and is configured to be moved by an appropriate movement mechanism.

The first sensor 13 detects a detection point 51 of the first web 1 every time the first web 1 is paused. The print pitch of the print patterns 50 is constant but can be distorted due to some causes. In this case, the first sensor 13 is slightly moved within the range of movement thereof to detect whether or not the detection point is shifted from the initial position, and further detects the shift distance of the detection point from the initial position if the detection point is shifted from the initial position. After completion of the detection, the first sensor 13 is returned to the initial position.

The detected shift distance is transmitted to the control device 16. The control device 16 controls the first motor 15 based on this shift distance. More specifically, if the detection point 51 is located downstream of the initial position, this means excess feed of the first web 1. Therefore, the control device 16 decreases the rotation amount of the first motor 15. In contrast, if the detection point 51 is located upstream of the initial position, this means insufficient feed of the first web 1. Therefore, the control device 16 increases the rotation amount of the first motor 15.

Repeating this causes the first web 1 to be intermittently fed at the print pitch thereof.

The above control is achieved every intermittent feed cycle. Alternatively, for example, after the shift distances of a plurality of the detection points 51 are detected, an average of the plurality of the shift distances may be calculated, and then the first motor 15 may be controlled based on the average so as to change the rotation amount thereof.

According to the above configurations, when the print pitch of the first web 1 is distorted from the desired pitch due to some causes such as quality or environment, the intermittent feed amount of the first web 1 by the first pair of feed rollers 14 is controlled to be changed in accordance with the distortion of the print pitch.

The intermittent feed device 7 further includes a second sensor 17 for detecting the detection points 53 of the print patterns 52 of the second web 2, a second pair of feed rollers 18 disposed downstream of the second sensor 17, and a second motor 19 for driving the second pair of feed rollers 18 based on signals from the second sensor 17.

An optical sensor is used as the second sensor 17. The detection points 53 of the second web 2 are optically detected by the second sensor 17. Rubber rollers are used as the second pair of feed rollers 18. A servomotor is used as the second motor 19. When the second pair of feed rollers 18 is driven by the second motor 19, at least one of the feed rollers rotates. Thus, when the second pair of feed rollers 18 is driven by the second motor 19, the second web 2 sandwiched between the second pair of feed rollers 18 is fed.

The second sensor 17 and the second motor 19 are connected to the control device 16. The second motor 19 is controlled by the control device 16 based on the signals from the second sensor 17 to drive the second pair of feed rollers 18 such that the second web 2 is intermittently fed at the print pitch of the second web 2 by the second pair of feed rollers 18.

This control will be described in detail. First, the number of rotations of the second pair of feed rollers 18 is set such that the second web 2 is intermittently fed at the print pitch thereof. From the aspect of facilitating the detection, the detection points 53 included in the second web 2 are, for example, high-contrast points (contrast changing points) repeated at the print pitch on the print patterns. The detection points 53 may be specific marks or codes. The second sensor 17 is disposed so as to oppose a detection point 53 of the second web 2 when the second web 2 is paused during the intermittent feed cycle. This position is defined as the initial position. The second sensor 17 is movable in the feed direction of the second web 2 and its opposing direction, and is configured to be moved by an appropriate movement mechanism.

The second sensor 17 detects a detection point 53 of the second web 2 every time the second web 2 is paused. The print pitch of the print patterns 51 is constant but can be distorted due to some causes. In this case, the second sensor 17 is slightly moved within the range of movement thereof to detect whether or not the detection point 53 is shifted from the initial position, and further detects the shift distance of the detection point 53 from the initial position if the detection point 53 is shifted from the initial position. After completion of the detection, the second sensor 17 is returned to the initial position.

The detected shift distance is transmitted to the control device 16. The control device 16 controls the second motor 19 based on this shift distance. More specifically, if the detection point 53 is located downstream of the initial position, this means excess feed of the second web 2. Therefore, the control device 16 decreases the rotation amount of the second motor 19. In contrast, if the detection point 53 is located upstream of the initial position, this means insufficient feed of the second web 2. Therefore, the control device 16 increases the rotation amount of the second motor 19.

Repeating this causes the second web 2 to be intermittently fed at the print pitch thereof.

The above control is achieved every intermittent feed cycle. Alternatively, for example, after the shift distances of a plurality of the detection points 53 are detected, an average of the plurality of the shift distances may be calculated, and then the second motor 19 may be controlled based on the average so as to change the rotation amount thereof.

According to the above configurations, when the print pitch of the second web 2 is distorted from the desired pitch due to some causes such as quality or environment, the intermittent feed amount of the second web 2 by the second pair of feed rollers 18 is controlled to be changed in accordance with the distortion of the print pitch.

The intermittent feed device 7 further includes a downstream pair of feed rollers 21 disposed downstream of the first and second pairs of feed rollers 14 and 18, and a downstream motor 22 for driving the downstream pair of feed rollers 21. A control device 20 is provided. The downstream motor 22 is connected to the control device 20. The control device 20 is independent of the control device 16.

Rubber rollers are used as the downstream pair of feed rollers 21. A servomotor is used as the downstream motor 22. When the downstream pair of feed rollers 21 is driven by the downstream motor 22, at least one of the feed rollers rotates. Thus, when the downstream pair of feed rollers 21 is driven by the downstream motor 22, the first and second webs 1 and 2 are guided to the downstream pair of feed rollers 21, superposed on each other, sandwiched between the downstream pair of feed rollers 21, and fed in a superposed state.

The downstream motor 22 is controlled by the control device 20 to drive the downstream pair of feed rollers 21 such that the first and second webs 1 and 2 are intermittently fed so as to keep the tension applied thereto constant. In the embodiment, the intermittent feed amount of the first and second webs 1 and 2 has been predetermined.

Figure 3:
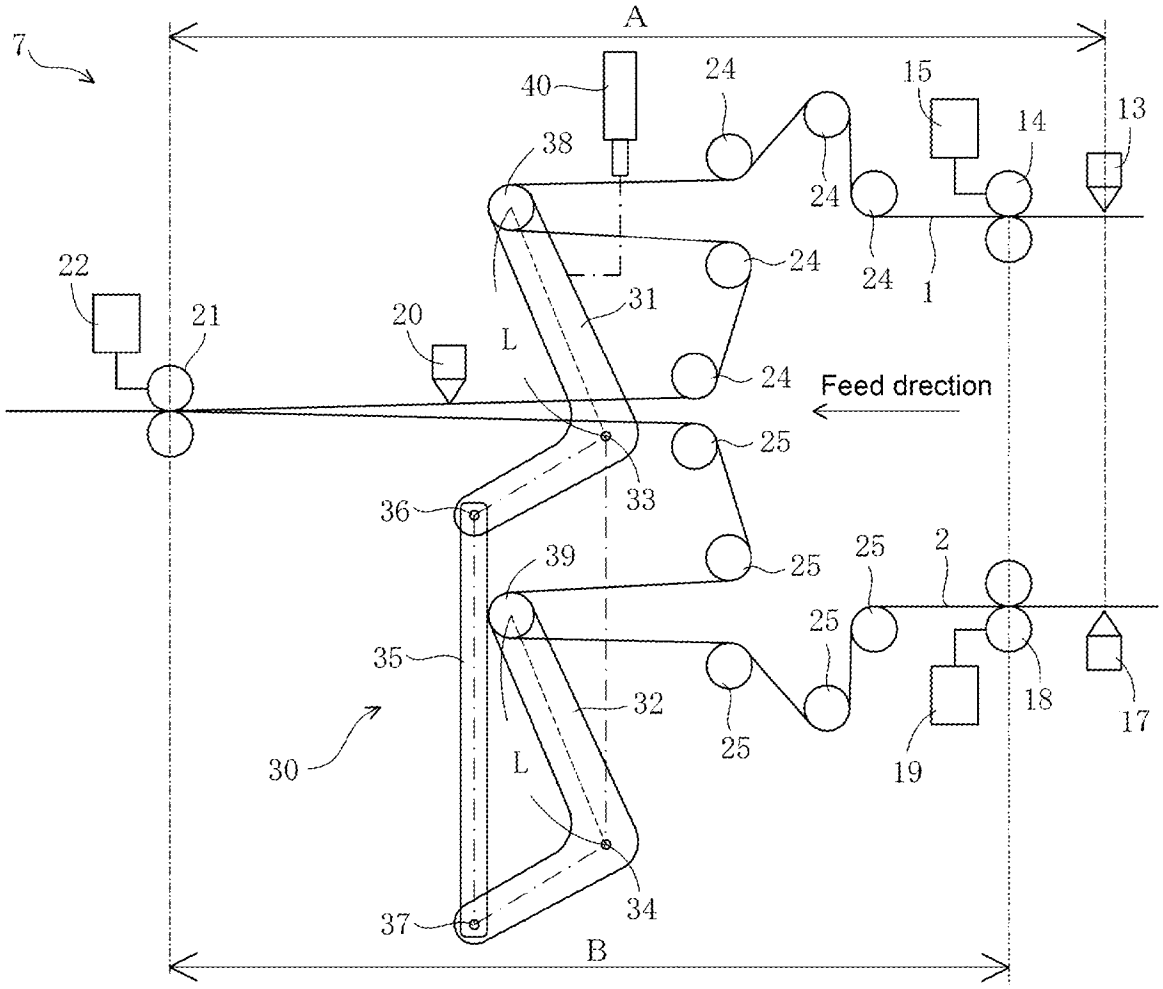
FIG. 3 is a schematic view of an intermittent feed device incorporated into the bag making apparatus in FIG. 1.

The intermittent feed device 7 further includes a parallelogram linkage 30. FIG. 3 illustrates the linkage 30 in detail. The intermittent feed device 7 further includes a first arm 31 supported at a first support point 33 by a frame (not shown) of the device to be pivotable about the first support point 33, and a second arm 32 supported at a second support point 34 by the frame of the device to be pivotable about the second support point 34 in the same direction as the first arm 31. The first and second arms 31 and 32 have the same length and same shape as each other. The first and second arms 31 and 32 are disposed in parallel with each other to be spaced from each other.

The intermittent feed device 7 further includes a link 35 disposed between the first and second arms 31 and 32. The link 35 is linked to the first arm 31 at a first link point 36 and to the second arm 32 at a second link point 37. Thereby, the linkage 30 with the first and second support points 33 and 34 and the first and second link points 36 and 37 as joints is constituted.

The intermittent feed device 7 further includes a first tension roller 38 supported by the first arm 31 to be spaced from the first support point 33 at the predetermined distance L, and a second tension roller 39 supported by the second arm 32 to be spaced from the second support point 34 at the same distance L. The first tension roller 38 is located downstream of the first pair of feed rollers 14 and upstream of the downstream pair of feed rollers 21 to engage with the first web 1. The second tension roller 39 is located downstream of the second pair of feed rollers 18 and upstream of the downstream pair of feed rollers 21 to engage with the second web 2. The first and second tension rollers 38 and 39 are configured to be pivoted by the linkage 30 in synchronization with each other by the same pivot amount.

The intermittent feed device 7 further includes a biasing member 40 for biasing the first and second tension rollers 38 and 39 via the linkage 30 to apply tension to the first and second webs 1 and 2. A cylinder is used as the biasing member 40. The biasing member 40 is connected to the first or second arm 31 or 32 to keep applying the constant tension to the first and second webs 1 and 2. The biasing member 40 acts on the linkage 30 to bias the first and second rollers 38 and 39 in the pivot direction of these rollers. Thereby, the tension is applied to the first and second webs 1 and 2 which are engaged with the first and second tension rollers 38 and 39.

A plurality of first guide rollers 24 is disposed downstream of the first pair of feed rollers 14 and upstream of the downstream pair of feed rollers 21 to engage with the first web 1. A plurality of second guide rollers 25 is disposed downstream of the second pair of feed rollers 18 and upstream of the downstream pair of feed rollers 21 to engage with the second web 2. The positional relationship between the first tension roller 38 and the first guide rollers 24 corresponds to the positional relationship between the second tension roller 39 and the second guide rollers 25.

As illustrated in FIG. 3, there are two path lines in a section A. One is a path line for the first web 1 from the first sensor 13 (that is, the initial position where the first sensor 13 detects the detection points 51 of the first web 1) to the downstream pair of feed rollers 21. The other is a path line for the second web 2 from the second sensor 17 (that is, the initial position where the second sensor 17 detects the detection points 53 of the second web 2) to the downstream pair of feed rollers 21. The section A includes a section B from the first pair of feed rollers 14/the second pair of feed rollers 18 to the downstream pair of feed rollers 21. The intermittent feed device 7 is configured such that both lengths of the path lines in the section B are substantially the same as each other and that both lengths of the path lines in the section A are the same as each other.

The first and second tension rollers 38 and 39 being pivoted by the linkage 30 causes both lengths of the path lines to change. Since the first and second tension rollers 38 and 39 are pivoted in synchronization with each other by the same pivot amount, both lengths of the path lines are shorten or elongated by the same amount by means of pivoting of the tension rollers 38 and 39. In other words, the intermittent feed device 7 is configured such that both lengths of the pass lines in the section A are maintained equal to each other even when the first and second tension rollers 38 and 39 are pivoted.

The first web 1 is intermittently fed to the section B at the print pitch thereof. The second web 2 is intermittently fed to the section B at the print pitch thereof. The print pitches of the first and second webs 1 and 2 are typically set equal to each other and constant. If there is no difference between the print pitch of the first web 1 and the print pitch of the second webs 2, the intermittent feed amount of the first web 1 to the section B and the intermittent feed amount of the first web 2 to the section B are the same as each other. Furthermore, as described above, both lengths of the path lines in the section A are the same as each other. Therefore, when the first and second webs 1 and 2 are superposed on each other, the print patterns 51 and the print patterns 53 are aligned with each other.

When there is a difference between the print pitch of the first web 1 and the print pitch of the second webs 2 due to variation in the print pitches, the intermittent feed amount of the first web 1 and the intermittent feed amount of the second web 2 are different from each other.

In this case, the first and second tension rollers 38 and 39 are biased by the biasing member 40 in the section B to apply tension to the first and second webs 1 and 2 such that at least the web with the shorter print pitch of the first and second webs 1 and 2 is stretched. Both lengths of the path lines in the section A are caused to be adjusted by this tension to the length of the web with the longer print pitch. Therefore, the web with the shorter print pitch is stretched to be adjusted to the web with the longer print pitch, so that the shorter print pitch is corrected to the longer print pitch. In other words, this stretch makes the print pitches of the first and second webs 1 and 2 aligned with each other. As a result, the number of print pitches and the web length which are included in the section A become the same for the first web 1 and for the second web 2.

The tension applied to the first and second webs 1 and 2 by the biasing member 40 at this time has been set in advance so as to prevent both of the first and second webs 1 and 2 from sagging in the section B. The drive force of the downstream pair of feed rollers 21 is fine if it is enough to enable the first and second webs 1 and 2 to be fed even under said tension. When the web with the shorter print pitch is being stretched by the tension, the web with the longer print pitch may also be being stretched by the tension. The above configurations make the stretch amount of the web with the shorter print pitch greater than the stretch amount of the web with the longer print pitch, and thus, even in this case, the print pitches of the first and second web 1 and 2 become aligned with each other.

As described above, even when the print pitches of the first and second webs 1 and 2 are different from each other, the print pitches are automatically corrected. The first and second webs 1 and 2 are intermittently fed by the downstream of feed rollers 21 with the print patterns thereof aligned with each other. The plastic bags with no misaligned print patterns are made by the process devices 10, 11 and 12.

The intermittent feed device 7 according to the present invention is capable of intermittently feeding the webs 1 and 2 while correcting the print pitches by means of the combination of the sensors 13, 17 and 20, the pairs of feed rollers 14, 18 and 21, the motors 15, 19 and 22, the linkage 30, the tension rollers 38 and 39, and the biasing member 40. The intermittent feed device 7 eliminates the need for application of heat and addition of the slide rollers and the slide roller drive mechanism to correct the print pitches, and thus provides a novel manner for correcting the print pitches.

Other embodiments will be described below. The first sensor 13 may detect a detection point 51 during every intermittent feed cycle the moment the detection point 51 is passing through the initial position, and the first motor 15 may be stopped by the control device 16 at this moment. Furthermore, when the first sensor 13 has not yet detected the detection point 51 at the initial position at the end of the intermittent feed cycle, the first sensor 13 may then be moved upstream until the first sensor 13 detects the detection point 51. The control device 16 uses this movement distance of the first sensor 13 as the shift distance, and drives the first motor 15 based on this shift distance such that the first web 1 is further fed by the first pair of feed rollers 14 by the shift distance.

Similarly, the second sensor 17 may detect a detection point 53 during every intermittent feed cycle the moment the detection point 53 is passing through the initial position, and the second motor 19 may be stopped by the control device 16 at this moment. Furthermore, when the second sensor 17 has not yet detected the detection point 53 at the initial position at the end of the intermittent feed cycle, the second sensor 17 may then be moved upstream until the second sensor 17 detects the detection point 53. The control device 16 uses this movement distance of the second sensor 17 as the shift distance, and drive the second motor 19 based on this shift distance such that the second web 2 is further fed by the second pair of feed rollers 18 by the shift distance.

Figure 4:
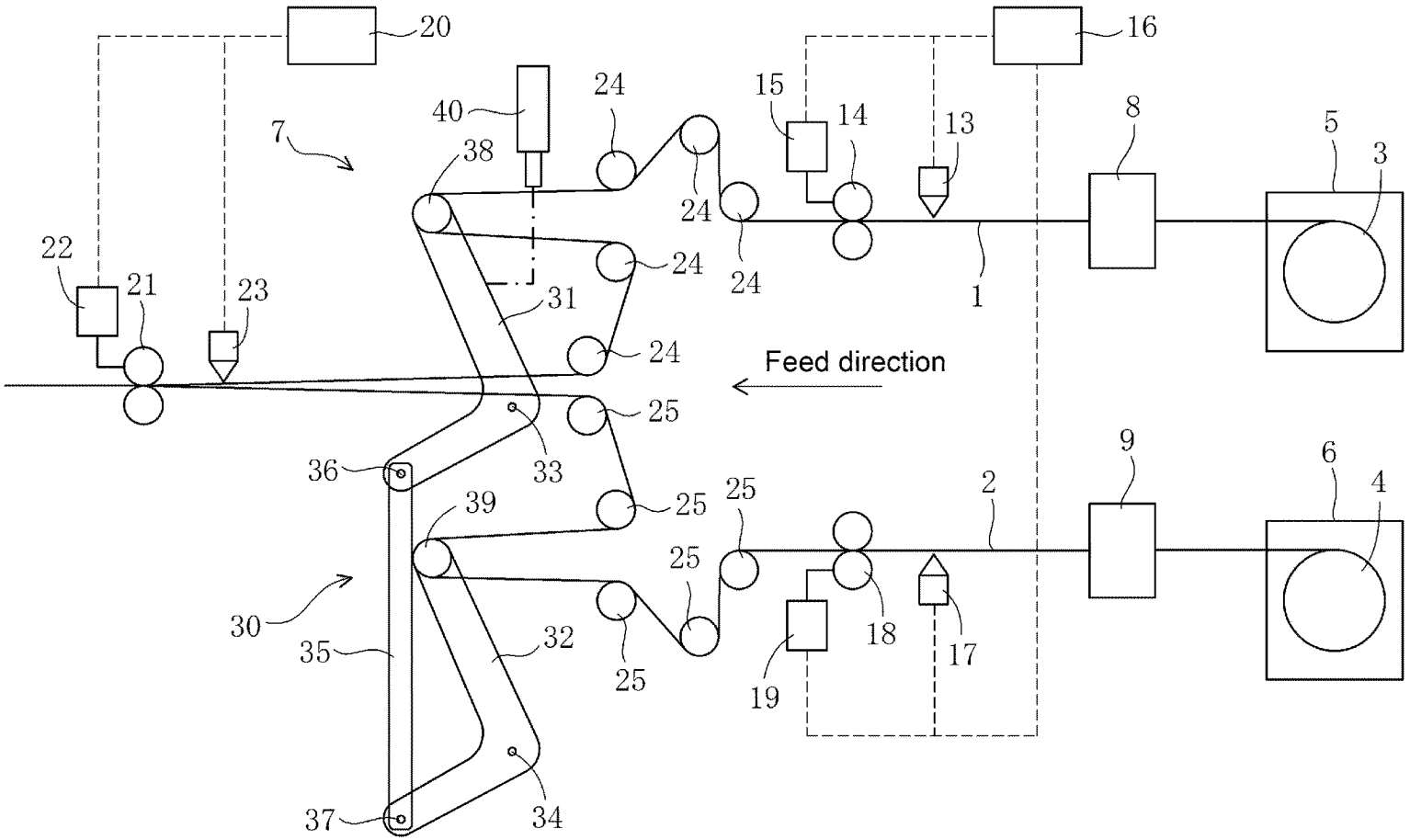
FIG. 4 is a schematic view of an upstream section of a bag making apparatus according to another embodiment.

The embodiment of FIG. 4 provides the control with higher accuracy. As illustrated in FIG. 4, a downstream sensor 23 is disposed upstream of the downstream pair of feed rollers 21. The downstream sensor 23 detects the detection points 51 of the print patterns 50 of the first web 1 in the same way as the first senor 13. The downstream sensor 23 is connected to the control device 20. The downstream motor 22 is controlled by the control device 20 based on detection signals from the downstream sensor 23 to drive the downstream pair of feed rollers 21.

Regarding the intermittent feed of the first and second webs 1 and 2, the downstream sensor 23, the downstream pair of feed rollers 21 and the downstream motor 22 operate in the same way as the first sensor 13, the first pair of feed rollers 14 and the first motor 15 intermittently feed the first web 1. In other words, the shift distance of the detection point 51 from the initial position is detected, and then the downstream motor 22 is controlled by the control device 20 so as to change the rotation amount thereof.

Also in the embodiment of FIG. 4, as with the above first and second sensors 13 and 17, after the shift distances of a plurality of the detection points 51/53 are detected, the average of the plurality of the shift distances may be calculated, and then the downstream motor 22 may be controlled based on the average so as to change rotation amount thereof.

As described above, the print pitch of the first web 1 and the print pitch of the second web 2 have been aligned with each other before the first and second webs 1 and 2 reach the downstream pair of feed rollers 21. Therefore, the downstream sensor 23 may be disposed to detect the detection points 53 of the second web 2 instead of the detection points 51 of the first web 1.

What is claimed is:

1. An intermittent feed device for intermittently feeding a first web unwound from a first roll and a second web unwound from a second roll, each of the first web and the second web having print patterns repeated at a print pitch, each of the print patterns including a detection point, the intermittent feed device comprising:

a first sensor for detecting the detection point of the first web;

a first pair of feed rollers disposed downstream of the first sensor;

a first motor for driving the first pair of feed rollers based on detection signals from the first sensor such that the first web is intermittently fed by the first pair of feed rollers at the print pitch of the first web;

a second sensor for detecting the detection point of the second web;

a second pair of feed rollers disposed downstream of the second sensor;

a second motor for driving the second pair of feed rollers based on detection signals from the second sensor such that the second web is intermittently fed by the second pair of feed rollers at the print pitch of the second web;

a downstream pair of feed rollers disposed downstream of the first pair of feed rollers and the second pair of feed rollers;

a downstream motor for driving the downstream pair of feed rollers such that the first web and the second web are intermittently fed in a superposed state by the downstream pair of feed rollers;

a first arm supported at a first support point to be pivotable about the first support point;

a second arm supported at a second support point to be pivotable about the second support point in a same direction as the first arm; and a link linked to the first arm at a first link point and to the second arm at a second link point, wherein a parallelogram linkage with the first support point, the second support point, the first link point and the second link point as joints is constituted, the intermittent feed device further comprising:

a first tension roller supported by the first arm to be spaced from the first support point at a first distance, the first tension roller being located downstream of the first pair of feed rollers and upstream of the downstream pair of feed rollers to engage with the first web;

a second tension roller supported by the second arm to be spaced from the second support point at a second distance same as the first distance, the second tension roller being located downstream of the second pair of feed rollers and upstream of the downstream pair of feed rollers to engage with the second web; and a biasing member for biasing the first tension roller and the second tension roller via the parallelogram linkage to apply tension to the first web and the second web, wherein, when the print pitches of the first web and the second web are different from each other, at least a web with a shorter print pitch of the first web and the second web is stretched by the biasing member such that the print pitches of the first web and the second web are aligned with each other.

2. The intermittent feed device of claim 1, wherein the biasing member is a cylinder.

* * * * *